United States Patent [19]

Kupfer

[11] 4,261,286

[45] Apr. 14, 1981

[54] APPARATUS FOR COATING OF MOVING SHEETS WITH A CONTACT ADHESIVE

[75] Inventor: Gerd A. H. Kupfer, Hamburg, Fed. Rep. of Germany

[73] Assignee: Maschinenfabrik Max Kroenert, Hamburg, Fed. Rep. of Germany

[21] Appl. No.: 55,816

[22] Filed: Jul. 9, 1979

[51] Int. Cl.[3] ..... B05C 1/12

[52] U.S. Cl. ..... 118/202; 118/246; 118/262

[58] Field of Search ..... 118/202, 60, 246, 262, 118/257

[56] References Cited

U.S. PATENT DOCUMENTS

| | | | |
|---|---|---|---|
| 2,329,034 | 9/1943 | Buck et al. | 118/246 X |
| 3,239,367 | 3/1966 | Demeter | 118/202 X |
| 3,363,530 | 1/1968 | Rice | 118/257 X |
| 3,667,422 | 6/1972 | Saladin | 118/202 X |
| 3,682,133 | 8/1972 | Gomarin et al. | 118/202 |
| 4,138,965 | 2/1979 | Riese et al. | 118/262 X |

*Primary Examiner*—John P. McIntosh

*Attorney, Agent, or Firm*—Becker & Becker, Inc.

[57] ABSTRACT

An apparatus for coating moving sheets with a contact adhesive, which apparatus includes rollers for forming a contact adhesive film and rollers for applying the film to a moving sheet, which application rollers include a cooling roller with an adhesive-rejecting envelope or sleeve, a processing roller, and a pivotal support for the pressing roller.

10 Claims, 2 Drawing Figures

APPARATUS FOR COATING OF MOVING SHEETS WITH A CONTACT ADHESIVE

The present invention relates to an apparatus for coating moving sheets with a contact adhesive which sheets are to be lined, as required, with a base. The apparatus includes heated applicator means for transferring a uniform hot melt contact adhesive film to a subsequent counterpressure roller to be passed thereover, over which counterpressure roller there is also passed the sheet to be coated with the adhesive film.

While self-adhesive tapes and the like have been produced for many years, during the production thereof, however, often considerable difficulties arise and up to now a substantial amount of reject material had to be taken into account during production of such tapes. The difficulties during coating reside primarily therein that the sheets which are to be coated are usually very thin and thermally not too stable. Since the hot melt contact adhesive film has to be sufficiently viscous, and, therefore, hot at the moment of application thereof at the coating material, there exists the danger that the thin sheet to be coated will be readily "destructured" when the temperature is not 100% accurate. Such "destructuring" can lead thereto that the final product does not have a planar surface and, thus is of unacceptable appearance and is difficult to be wound into the desired roll-form. With the known apparatus for coating of moving sheets with a hot melt contact adhesive film thus, the temperature control had to be within +/−0.1° C. Temperature control means for such accurate temperature adjustments, however, are normally prohibitively expensive, are readily rendered ineffective, and are difficult to be manually readjusted.

It is, accordingly, an object of the present invention to provide an apparatus for coating moving sheets with an adhesive, which apparatus is substantially of simple construction and which affords an improved removal of heat from the material which is to be coated, so that the loss due to "destructurizing" of the moving sheets or webs is avoided, while simultaneously avoiding that the still warm hot melt contact adhesive film is not applied in a uniform manner.

Figure 1:
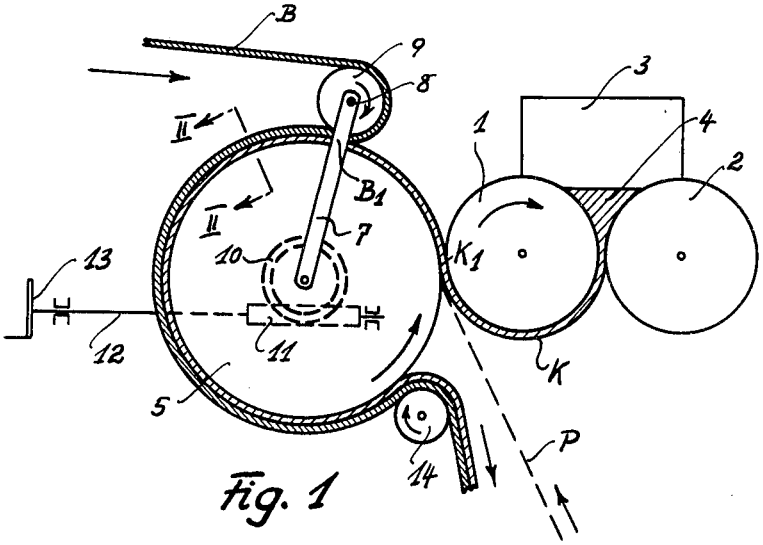
Figure 2:
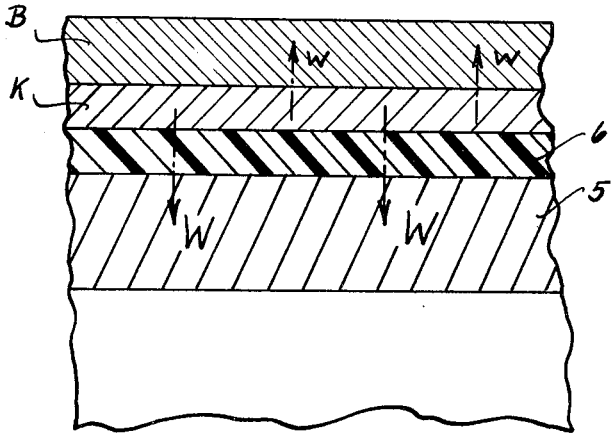

This object and other objects and advantages of the invention will appear more clearly from the following specification in connection with the accompanying drawings, in which:

FIG.1 is a diagrammatical representation, partly in section, of an apparatus in accordance with one embodiment of the present invention; and FIG. 2 is a cross section along line II—II of FIG. 1, drawn to a larger scale.

The apparatus according to the present invention is characterized primarily by a counterpressure roller, serving as a cooling roller, having means for providing a non-adhesive contact with the pertaining adhesive film being passed thereover and by a pressing roller about which the sheet to be coated ia passed, which pressing roller serves to press into, and maintain in, contact the sheet to be coated with the film that is to be applied as the coating; with means being provided for movably mounting the pressing roller so that the distance between the point of first contact of the adhesive film on the counterpressure roller or cooling roller and the point of first contact between the sheet to be coated and the pertaining adhesive film can be varied.

Because of the means for movably mounting the pressing roller there is provided the opportunity to vary the point of first contact of the sheet to be lined with a base in such a manner, at a distance from the point of first contact of the adhesive film on the cooling roller, that the contact adhesive film is at that temperature which is required for the coating, i.e. at a temperature at which the sheet which is to be coated is not detrimentally destructured. It is apparent that, accordingly, no special sensitively reacting temperature control will be required.

According to a further embodiment of the invention, for the production of lined self-adhesive tapes and the like also the sheet which is to serve as the lining material, customarily provided by a silicon sheet, can be admitted in the region of the counterpressure or cooling roller, and, particularly immediately at or prior to the roll gap formed between the applicator roller and the couterpressure roller. Because, in this manner, the hot melt film does not directly contact the outer surface of the cooling roller the latter may be without a permanent means for providing a non-adhesive contact, and the silicon paper will serve to ensure that the hot viscous adhesive film will not detrimentally adhere to the counterpressure or cooling roller.

In accordance with yet another embodiment of the invention, the means for movably mounting the pressing roller include a rocker arm and the pressing roller includes a roller made of a material which is a poor heat conductor, preferably a rubber roller.

In accordance with another embodiment of the invention, the means for producing and supplying the film to be applied as the coating include a heated driven applicator roller, a generally stationary dosage roller which can also be heated, and a container for the composition to provide the pertaining contact adhesive film, which container is positioned above the roll gap formed between the dosage roller and the applicator roller, with the speed of the subsequent counterpressure or cooling roller being substantially greater than that of the applicator roller so as to stretch and thin the contact adhesive film.

In accordance with yet another embodiment of the invention, the means for providing non-adhesive contact of the counterpressure or cooling roller is provided by a material having a definite contact adhesive rejection to the pertaining adhesive, preferably a silicon treated material to be used as a lining material, which material is fed to the circumference of the counterpressure or cooling roller in the direction of rotation at or prior to the roll gap formed between the counterpressure roller and the applicator roller.

In accordance with another preferred embodiment, the counterpressure or cooling roller is succeeded by a comparatively large dimensioned further cooling roller.

Referring now particularly to the drawings, in these the roll gap and the thicknesses of the sheet to be coated and the contact adhesive film have been drawn at an exaggerated scale in order to more clearly illustrate the function of the coating apparatus.

The apparatus for coating moving sheets with an adhesive includes means for producing and supplying, which are known per se, in which a mass consisting of the hot melt of contact adhesive melt is heated to the pertaining melting temperature and subsequently is sprayed to provide a uniform contact adhesive film. Such a means can be provided, as desired, i.e. it can be a screen or wiper (Rakel) or an extrusion arrangement, a jet applicator system, or a multi-roller applicator system.

FIG. 1 of the drawings shows a double-walled applicator roller 1 which is adapted to be heated by means of an oil capable of transfer of calorific values and which applicator roller 1 can be driven or powered by means of a continuously variable control transmission, not shown. This applicator roller 1 forms a roll gap with a dosage roller 2 made of steel. The dosage or dosing roller 2 can also be heated by means of a double-wall arrangement. The roll gap between the applicator roller 1 and the dosage roller 2 determines the thickness of the adhesive film which is passed over the applicator roller, generally designated by the letter "K". Above the two rollers 1 and 2 there is provided a hot melt container 3 which contains the mass 4 of the material to be formed into the contact adhesive film. The dosage roller 2 can be moved relative to the applicator roller 1 in order to vary the roll gap. Preferably dosage roller 2 is not driven (stationary). For the purpose of cleaning, however, the dosage roller 2 may be driven.

It may be mentioned here that in the known apparatus for the coating of sheets with an adhesive film the sheet to be coated would extend past the lowest point of the applicator roller, and would there be pressed against the applicator roll by the intervention of a rubber coated counterpressure roller in such a manner that the sheet would remove the film from the applicator roller. Subsequently the sheet provided with the adhesive film would be passed to a large dimensioned cooling roller which would operatively contact, for cooling of the sheet and the coating, the sheet on the side free of the coating in a manner that between the applicator roller and the subsequent cooling roller the sheet furnished with fluid contact adhesive film would lose on the cooling roller such an amount of heat that it could subsequently be unwound. However, particularly the distance between the applicator roller and the cooling roller up to now was contributing often to the destructuring effect of the sheet to be coated which was often subjected over an extended period of time to the higher temperature of the adhesive film.

In accordance with one aspect of the present invention, the applicator roller 1 is associated with a cooling or counterpressure roller 5 which receives in the gap formed between the applicator roller 1 and cooling roller 5 the contact adhesive film designated "K". In order that the film "K" does not adhere on the cooling roller 5, there is provided on cooling roller 5 a coating, sleeve, or envelope 6 (FIG. 2). In this manner, the temperature of the film "K" will already be reduced starting at the point of first contact "$K_1$", i.e. at the roll gap between rollers 1 and 5. In order that the sheet to be coated designated "B" is contacting the film "K" at the most advantageous point, i.e. at a point at which the film is still sufficiently hot—but not so hot so as to destructure the sheet—the sheet "B" is passed over pressing roller 9. The pressing roller 9, having a longitudianl central axis 8, is mounted by a rocker arm 7, serving as means for movably mounting the pressing roller 9, which rocker arm can be rotated or swung about the central axis of cooling roller 5. In order to achieve such a rotation or swinging movement, there is provided on the inner journal axis of the rocker arm 7 a worm wheel 10 which is operatively engageable with a pertaining worm 11. When the worm 11 is rotated by means of a connection shaft 12 and a hand wheel or crank wheel 13, the contact point, designated by "$B_1$" of the sheet "B": on the cooling wall, i.e. during operation, on the film "K", is varied relative to the point "$K_1$" of film "K". The distance between the two points of contact, "$K_1$" and "$B_1$", which indicate the extent of the arc relative to the central axis of the cooling roller 5, determines, in a practical manner, the temperature which the film "K" will have when it is contacted by the sheet "B" to which it is to be applied. The temperature control employed in the past exclusively is, accordingly, at least in part provided, in accordance with one aspect of the present invention, by the change of the distance between the points "$K_1$" and "$B_1$".

Results obtained during operaton of the apparatus according to the invention indicate that the change of the position of the rocker arm 7 affords for a far better compensation of temperature fluctuations, in a manner that with a particularly high degree of confidence the danger of destructuring of the sheet "B" can be eliminated.

Once the point of first contact of sheet "B" with the film "K" has travelled about the circumference to approach the deflector roller 14, the band will have cooled to such an extent that it can be wound as required. The deflector roller 14 provided at the circumference of the cooling roller 5 serves to facilitate lifting off of the coated sheet or band "B" which can then be passed in the known, customary manner to the winding-up mechanism, not shown.

FIG. 2 shows a diagrammatical cross-sectional representation indicating the heat transfer from the composite comprised of band "B" and film "K"in the direction of rotation behind point "$B_1$". The larger portion of the heat "W" to be released from the film "K" passes through the coating or envelop 6 into the cooling roller 5 formed as a hollow cylinder. Due to this greater heat transfer, the sheet "B" to be coated receives only a relatively minor amount of heat "W" which is not of such a magnitude as to cause "destructuring" of the sheet "B".

When it is desired to provide the band "B" to which a film "K" is to be applied, also with a protective lining on the film "K", a sheet "P" in FIG. 1 can be fed into the roll gap between rollers 1 and 5 at the point of contact designated "$K_1$", as is indicated in the dash lines (FIG. 1). Preferably the band "P" includes a silicon paper. This silicon paper "P" receives in a roll gap at point "$K_1$" the film "K" from the applicator roller 1. Since such a lining silicon paper "P" has already a very low affinity to the contact adhesive film, in such a case the cooling roller 5 need not be provided with a particular adhesive-rejecting coating or envelope 6, i.e. a coating having a low contact-affinity for the film "K". The coating 6, when such a coating is used is preferably comprised of silicon-rubber. The operation of an apparatus having a special coating or which employs the silicon paper is essentially the same. Also regarding heat transfer, no particular differences are present since in the place of the silicon-rubber coating 6, there is used the silicon paper "P".

It may be mentioned that in accordance with the present invention the counterpressure or cooling roller 5 can be operated at a considerably higher speed than the applicator roller 1, for example with a ten times greater number of revolutions. In this manner, the film "K" can be stretched and can be made thinner. For example, when the film "K" on the applicator roll 1 has a thickness corresponding to 200 g/m$^2$ and when the roller 5 is operated at a velocity ten times greater than the applicator roller 1, a film results on the roller 5 having a thickness corresponding 20 g/m$^2$.

It may be mentioned, that the counterpressure or cooling roller 5 may be succeeded by a large-dimensioned wider cooling roller, not shown, as are known in the act.

The present invention is, of course, in no way restricted to the specific disclosure of the specification and drawings, but also encompasses any modifications within the scope of the appended claims.

What I claim is:

1. An apparatus for coating moving sheets with a contact adhesive, especially during the production of self-adhesive tapes and the like, said apparatus comprising in combination:

means for supplying a hot-melt adhesive in the form of a film having a predetermined uniform thickness and being of a predetermined temperature;

cooling roller means positioned adjacent said supplying means for receiving and cooling said film supplied by said supplying means, said cooling roller means having a central axis and being adapted to make non-adhesive contact with said film which is passed thereover, said roller means being in effective contact therewith along an arc between a point of first contact and a point at which said film disengages said roller means, said point of disengagement being remote from said point of first contact;

a pressing roller, positioned adjacent said cooling roller means, for supplying and pressing a sheet onto said film, which is passed over said cooling means, at a point of first coating, said point of first coating being located between said point of first contact and said point of disengagement; and means for movably mounting said pressing roller so that the distance of extent of the arc between two points of contact defined by said point of first contact and said point of first coating relative to central axis of said cooling roller means can be varied for most advantageous application temperature that the film has when contacted by the sheet.

2. An apparatus in combination according to claim 1, wherein said mounting means includes a pivotal arm, one end of which is coaxially pivotally mounted to said cooling roller means, and the other end of which carries said pressing roller.

3. An apparatus in combination according to claim 1, wherein said pressing roller is formed of a poor heat-conducting material.

4. An apparatus in combination according to claim 1, wherein said pressing roller is a rubber roller.

5. An apparatus in combination according to claim 1, wherein said means for supplying a uniform hot melt adhesive film includes: p1 a non-driven heated dosing roller;

a driven heated applicator roller positioned between said dosing roller and said cooling roller means for providing a roll gap between said dosing and applicator rollers for controlling the thickness of a film to be supplied; and a container for supplying hot-melt adhesive to said roll gap, with the hot melt adhesive being adapted to pass to the roll gap by gravity flow; and wherein said cooling roller means includes a driven cooling roller adapted to be driven at a greater speed than the said applicator roller for stretching and reducing the thickness of a pertaining film.

6. An apparatus in combination according to claim 5, wherein said non-adhesive contact is provided by a coating surrounding said cooling roller.

7. An apparatus in combination according to claim 6, wherein said coating is silicon-rubber.

8. An apparatus in combination according to claim 5, wherein said non-adhesive contact is provided by a pertaining lining sheet passed between a pertaining film and said cooling roller means at least at said point of first contact.

9. An apparatus in combination according to claim 8, wherein said lining material is silicon-treated.

10. An apparatus in combination according to claim 5, wherein said cooling roller means includes a further cooling roller operatively following said driven cooling roller.

* * * * *

UNITED STATES PATENT AND TRADEMARK OFFICE

CERTIFICATE OF CORRECTION

PATENT NO. : 4261286

DATED : 14 April 1981

INVENTOR(S) : Gerd A.H. Kupfer

It is certified that error appears in the above—identified patent and that said Letters Patent is hereby corrected as shown below:

On the title page, the following should be added:

[30] Foreign Application Priority Data

July 7, 1978 [DE] Fed. Rep. of Germany....2829886

Signed and Sealed this

*Seventh* Day of *July 1981*

[SEAL]

*Attest:*

RENE D. TEGTMEYER

*Attesting Officer* *Acting Commissioner of Patents and Trademarks*